US009498692B2

(12) United States Patent
Bledsoe et al.

(10) Patent No.: US 9,498,692 B2
(45) Date of Patent: Nov. 22, 2016

(54) ATHLETIC TRAINING SYSTEM

(71) Applicants: Hunter Bledsoe, Nashville, TN (US); Lantz Wheeler, Brentwood, TN (US)

(72) Inventors: Hunter Bledsoe, Nashville, TN (US); Lantz Wheeler, Brentwood, TN (US)

( * ) Notice: Subject to any disclaimer, the term of this patent is extended or adjusted under 35 U.S.C. 154(b) by 16 days.

(21) Appl. No.: 14/747,467

(22) Filed: Jun. 23, 2015

(65) Prior Publication Data

US 2016/0310811 A1 Oct. 27, 2016

Related U.S. Application Data

(60) Provisional application No. 62/015,658, filed on Jun. 23, 2014.

(51) Int. Cl.
*A63B 69/36* (2006.01)
*A63B 69/00* (2006.01)

(52) U.S. Cl.
CPC ..... *A63B 69/0059* (2013.01); *A63B 69/0002* (2013.01); *A63B 69/3608* (2013.01); *A63B 2069/0006* (2013.01); *A63B 2208/0204* (2013.01)

(58) Field of Classification Search
CPC ..... A63B 69/0002; A63B 69/0059; A63B 69/3608; A63B 69/0057; A63B 2069/0004; A63B 2069/0006; A63B 2208/0204
See application file for complete search history.

(56) References Cited

U.S. PATENT DOCUMENTS 5,188,365 A * 2/1993 Picard ..... A63B 69/0059 473/212
5,993,362 A * 11/1999 Ghobadi ..... A63B 21/0004 482/121
6,012,993 A * 1/2000 Guerriero ..... A63B 21/4025 182/3
6,129,638 A * 10/2000 Davis ..... A63B 69/0059 473/215
7,314,437 B2 * 1/2008 Frappier ..... A63B 21/00065 482/124
2004/0138013 A1 * 7/2004 Socci ..... A63B 69/0002 473/458
2006/0229176 A1 * 10/2006 Erez ..... A63B 69/0059 482/124
2007/0232404 A1 * 10/2007 Begert ..... A63B 21/0004 473/216
2008/0224460 A1 * 9/2008 Erez ..... A63B 69/0059 280/801.1
2012/0178067 A1 * 7/2012 Stanfield ..... A63B 69/0059 434/247
2012/0322038 A1 * 12/2012 Brannagan ..... A63B 69/0024 434/247
2013/0324328 A1 * 12/2013 Parker ..... A63B 69/002 473/438
2016/0089565 A1 * 3/2016 McCrane ..... A63B 69/0059 482/93

* cited by examiner

*Primary Examiner* — Releigh W Chiu
(74) *Attorney, Agent, or Firm* — Gary K. Price

(57) ABSTRACT

An athletic training system used when practicing athletic training activities. The athletic training system includes a belt and means for maintaining the belt in place and prevent the belt from rotating or slipping during application which can occur due to the forces placed on the belt during application. The belt is secured beneath the user's waist and partially surrounds each of the user's thighs. To further maintain the belt in place, a pair of thigh straps depend about the inside of the users thighs to partially surround the thighs. First and second hip members outwardly extend from the side-ends of the belt. Each of the hip members form a triangle configuration with a part of the triangle extending from above the user's hip joint and a part of the triangle extending from below the user's hip joint during application. An elastic resistance band includes one end that is secured to a support, and an opposite end releasably attached to one or both of the hip members.

20 Claims, 5 Drawing Sheets

ATHLETIC TRAINING SYSTEM

CROSS REFERENCES TO RELATED APPLICATIONS

U.S. Provisional Application for Patent No. 62/015,658, filed Jun. 23, 2014, with title "Athletic Training System" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to athletic training aids, and more particular to a support belt that is worn about the users hips or waist and thighs and is in cooperation with a resistance band to control rotation of the user's hip joint and upper body such that the hip joint and upper body act as a unit when practicing in athletic training activities.

2. Brief Description of Prior Art

In certain sporting activities it is advantageous to learn and achieve proper hip and upper body rotation to achieve sufficient speed and control for optimal performance. Proper pitching motion in baseball, for example, requires a coordinated and controlled rotation of the arm, shoulder, wrist, hips and waist. The same can be generally said for a proper golf swing. The rotation of the body, particularly the hips and upper body is critical to achieving optimal performance. This motion, however, when properly executed, is not a natural body movement and not readily learned by mere repetition or unassisted instruction.

Various training aids are known that provide waist and thigh straps. However these training aids are known to actually include restraining or resistance straps that often interfere with the normal athletic motion, for example, interfere with the user's normal pitching motion.

As will be seen from the subsequent description, the preferred embodiments of the present invention overcome disadvantages of the prior art. In this regard, the present athletic training system discloses a training aid that controls rotation of the user's hip joint and upper body such that the hip joint and upper body act as a unit when practicing in athletic training. The present invention was developed to force the user's hips and upper body to act as a unit during the athletic motion, while not interfering with the motion. The strap assembly securely mounts to the hips of the user and selectively controls and guides body motion during training activities. Still other objects will become apparent from the more detailed description which follows.

SUMMARY OF THE INVENTION

An athletic training system that is used when practicing in athletic training activities. The athletic training system includes a support belt that is worn about the user's hips or waist and thighs and is in cooperation with a resistance band to control rotation of the user's hip joint and upper body such that the hip joint and upper body act as a unit when practicing in athletic training activities.

The athletic training system generally includes a first belt, and second and third belts that maintain the first belt in place and prevent the first belt from rotating or slipping during application which can occur due to the forces placed on the first belt during application.

The first, second and third belts are secured beneath the user's waist and partially surrounds each of the user's thighs. To further maintain the first belt in place and prevent the first belt from supping, the system further includes a pair of thigh straps that depend about the inside of the user's thighs to partially surround the thighs.

The system further includes first and second hip members that outwardly extend from opposite side-ends of the first belt. The hip members each include first and second straps, where first ends of the first straps outwardly extend from a point on the first belt that is above the user's hip joint, and first ends of the second straps outwardly extend from a point on the first belt that is below the user's hip joint. Opposite or second ends of the first and second straps merge and include a ring such that each of the hip members form a triangle configuration with a part of the triangle extending from above the user's hip joint and a part of the triangle extending from below the user's hip joint during application.

An elastic resistance band includes one end that is secured to a suitable stationary support, and an opposite end is releasably attached to one or both of the hip members' rings.

DESCRIPTION OF THE PREFERRED EMBODIMENT

Figure 1:
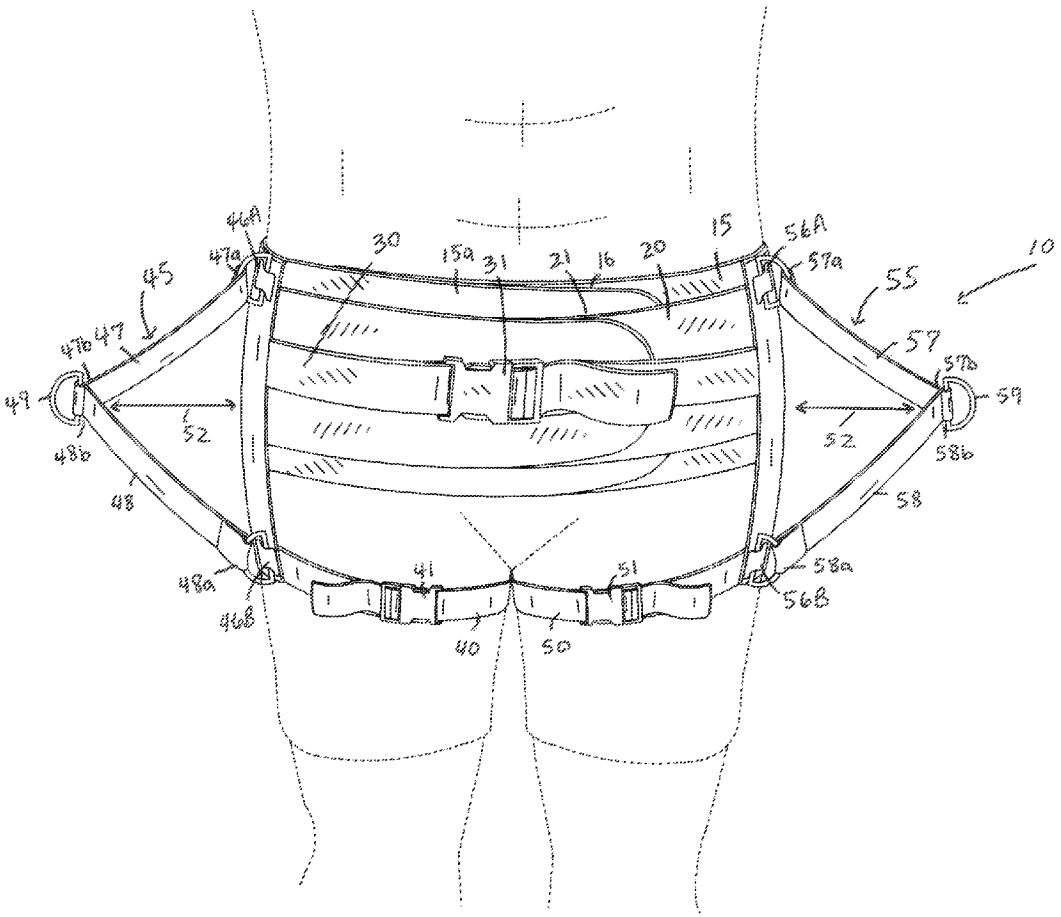
FIG. 1 is a front view of the device of the present invention, an athletic training system illustrated being worn by a user in broken lines.

The device of the present invention is directed to an athletic training system that is used when practicing in athletic training activities. The athletic training system includes a support belt that is worn about the user's hips or waist and thighs and is in cooperation with a resistance band to control rotation of the user's hip joint and upper body such that the hip joint and upper body act as a unit when practicing in athletic training activities. Unlike the prior art, the present invention was developed to force the user's hips and upper body to act as a unit during the athletic motion, while not interfering with the motion. As will be described, the athletic training system as disclosed further consists of components configured and correlated with respect to each other so as to attain the desired objective.

Referring to the drawings, an athletic training system, generally designated as numeral 10 is disclosed. As illustrated, the system 10 generally includes a first belt (layer) 15 preferably constructed of a stretchable nylon material, a second belt 20 preferably constructed of a stretchable nylon material, and a third belt 30 preferably constructed of a nylon webbing material. The first and second belts 15, 20 include attachment means 16, 21, respectively, which is preferably a Velcro attachment as is known in the art. The third belt 30 includes attachment means 31 which is preferably a buckle attachment as is known in the art.

Figure 2:
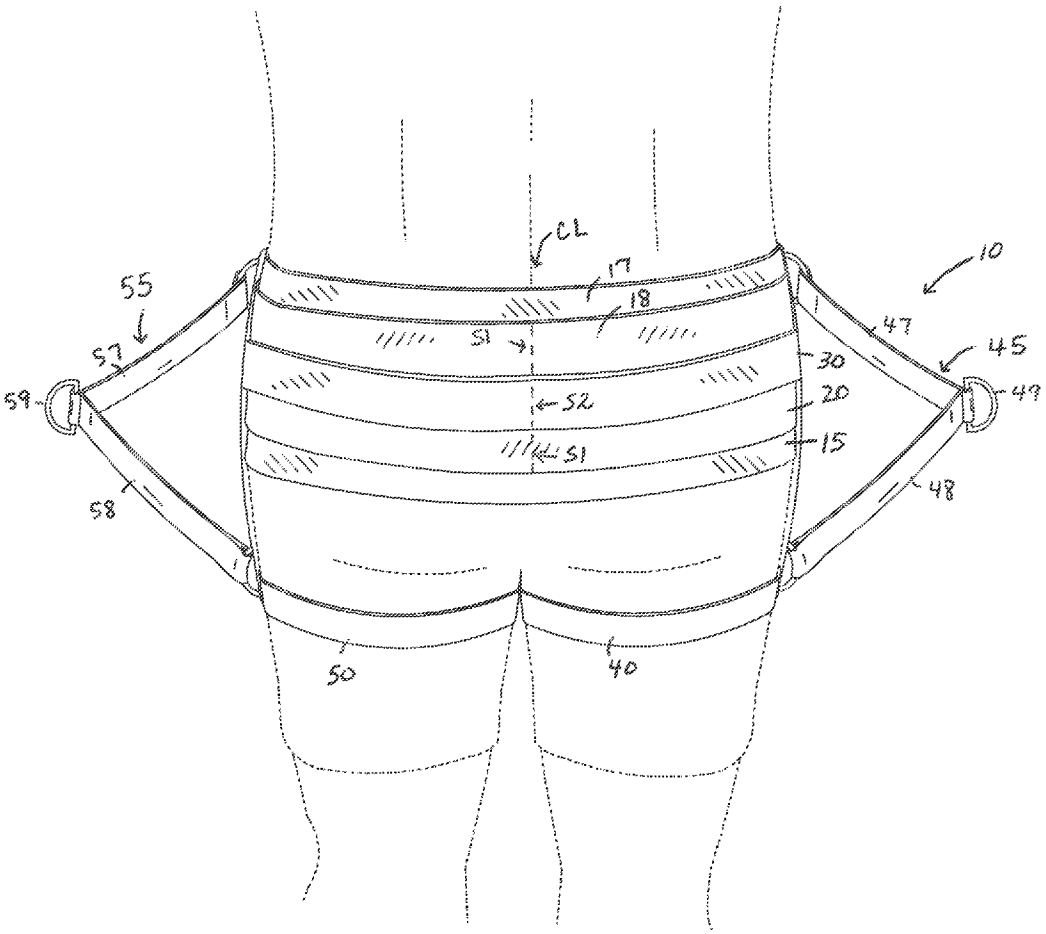
FIG. 2 is a rear view of the athletic training device of FIG. 1.
Figure 3:
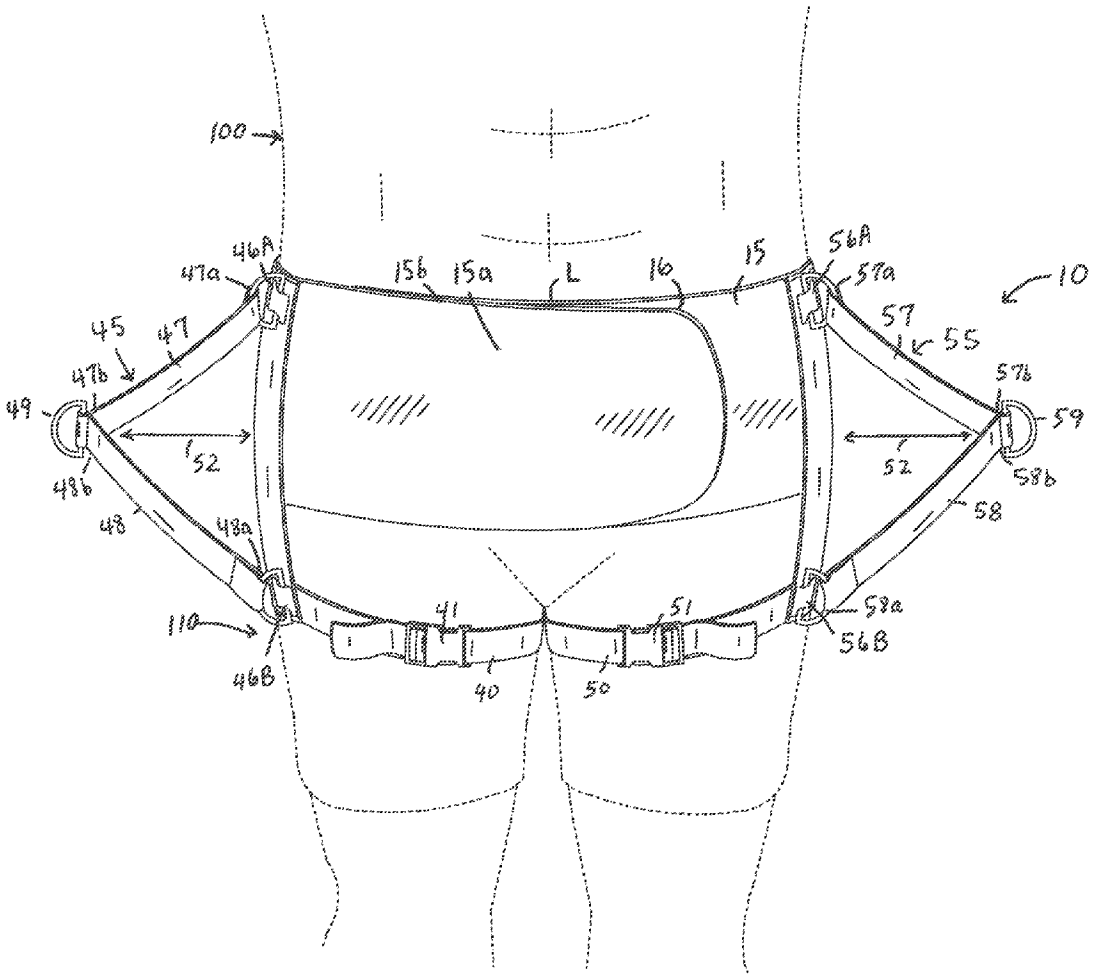
FIG. 3 is a front view of the device illustrating the first belt.
Figure 4:
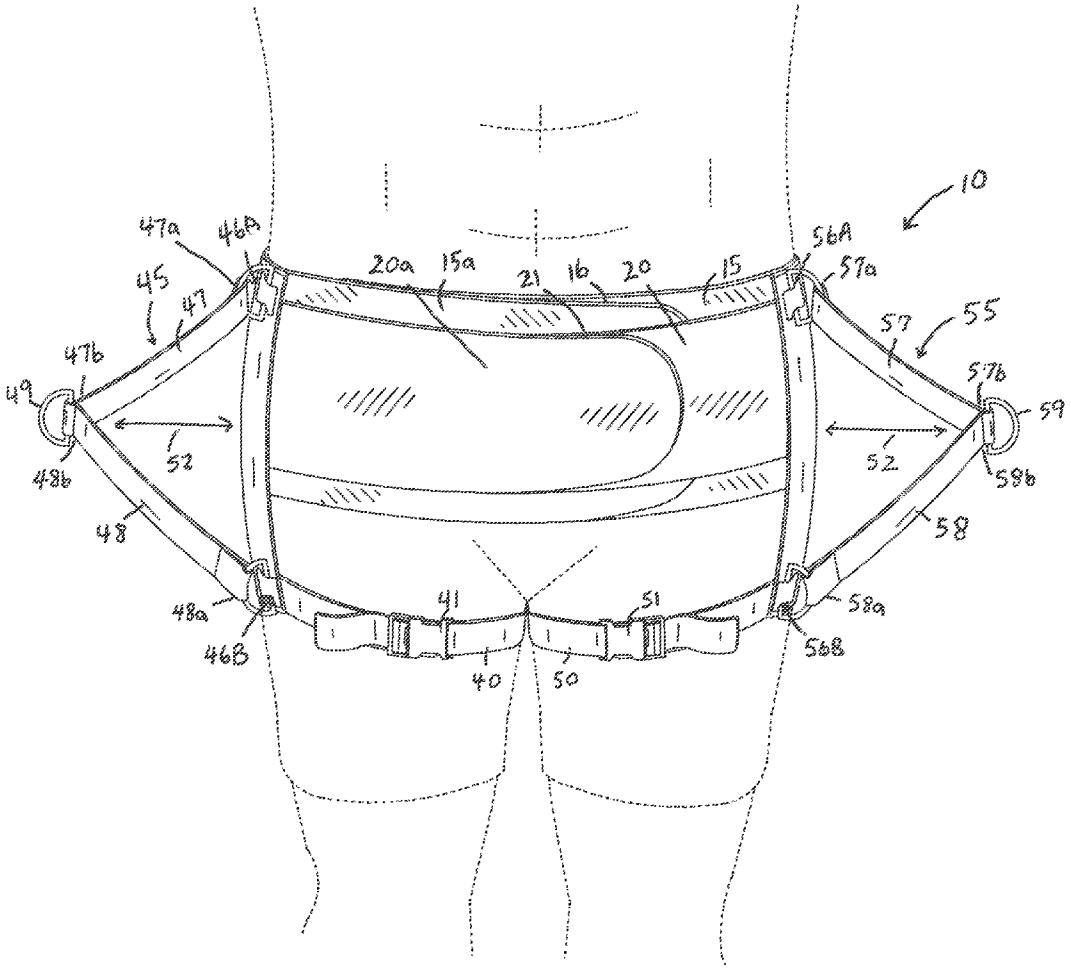
FIG. 4 is a front view of the device illustrating the first belt and second belt.

The first belt 15 includes a strap portion 15*a* that is normally secured around the user's waist 100 and releasably affixed at an approximate central location L (see FIG. 2) of a front portion 15*b* of the strap 15*a* with attachment 16. The first belt 15 downwardly extends approximately to the user's 100 thighs 110. The strap portion 15*a* is approximately 9 inches in width. The second belt 20 is attached to the first belt 15 and releasably secured around the user's waist at an approximate central location of a front portion 20*a* (see FIG. 4) of the second belt 20 with attachment 21. The second belt 20 is approximately 4 inches in width. The third belt 30 is attached to the second belt 20 and secured in application with attachment 31. As will be understood, the second and third belts 20, 30 assist to maintain the first belt 15 in place and prevent the first belt 15 from rotating or supping during application which can occur due to the forces placed on the first belt 15 during application.

The second belt 20 is appropriately attached to the first belt 15 preferably with stitching S1 known in the art, such stitching located at a central location CL (see FIG. 2) of a back portion 17 of the strap portion 15*a*. Similarly, the third belt 30 is appropriately attached to the second belt 20 preferably with stitching S2, such stitching located at the central location of the back portion 18 of the second belt 20.

To further maintain the first belt 15 in place and prevent the first belt 15 from slipping, the first belt 15 includes thigh straps 40, 50 that in application, depend about the inside of the users thighs to partially surround the thighs. The thigh straps 40, 50 each include attachment means 41, 51, respectively, which are preferably a buckle attachment as is known in the art.

The first belt 15 further includes a first and second hip member 45, 55 that outwardly extend from first and second locations 46A, 46B and 56A, 56B, respectively, of the first belt 15. As illustrated the first and second hip members 45, 55 on opposite side-ends of the first belt 15.

The hip members 45, 55, each include a first strap 47, 57, and a second strap 48, 58. It is critical that a first end 47*a* of the strap 47 outwardly extends from a point 46A on the belt 15 that is positioned approximately above the user's hip joint, and that a first end 57*a* of the strap 57 outwardly extends from a point 56*b* on the belt 15 that is positioned approximately above the user's hip joint. It is also critical that a first end 48*a* of the strap 48 outwardly extends from a point 46B on the belt 15 that is positioned approximately below the user's hip joint, and that a first end 58*a* of the strap 58 outwardly extends from a point 568 on the belt 15 that is positioned approximately below the user's hip joint.

As illustrated, opposite or second ends 47*b*, 57*b*, of the straps 47, 57, respectively, merge with opposite ends 48*b*, 58*b* of the straps 48, 58 and are affixed to a ring 49, 59, respectively. In application, and as illustrated, a spacing 52 is disposed between the rings and the strap portion 15*a*, the second belt 20 and the third belt 30.

The hip members 45, 55, having the first end of the first and second straps outwardly extending from the first belt 15 and the opposite or second ends merging as illustrated form a triangle T configuration that extends from the position 46A, 56A above the user's hip joint to the position 468, 568 below the user's hip joint during application.

Figure 5:
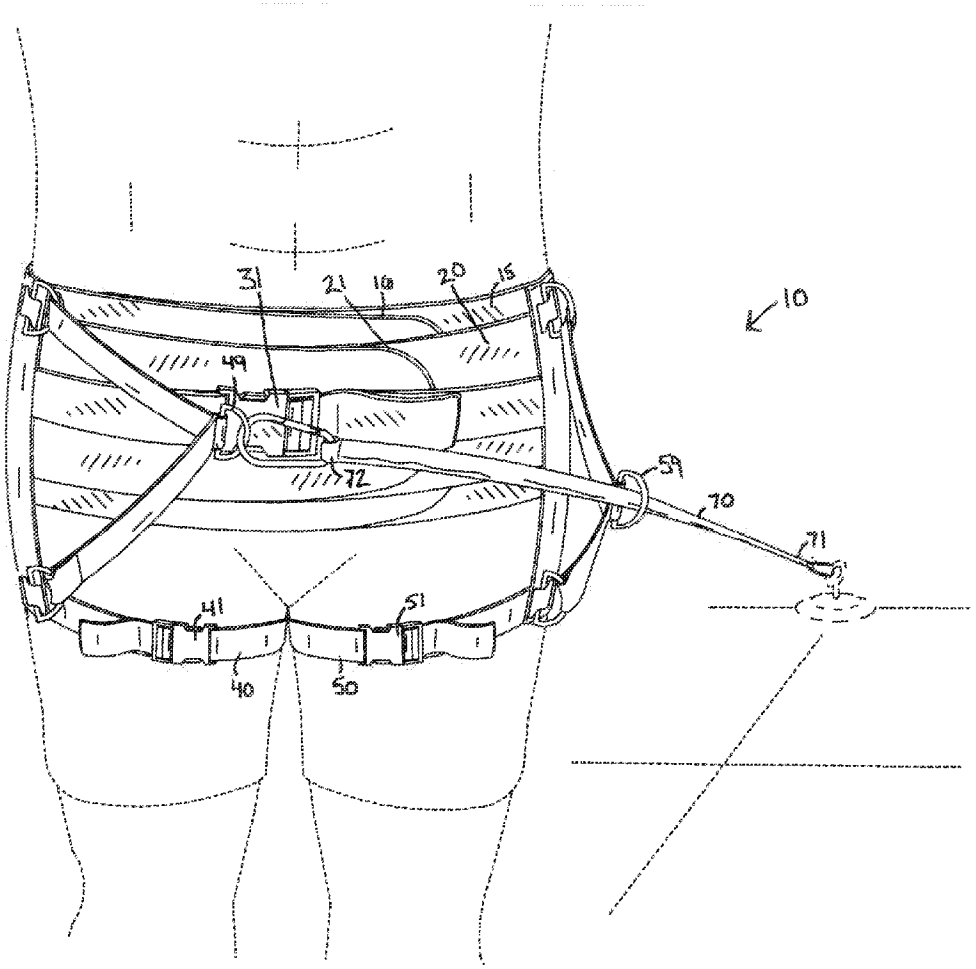
FIG. 5 is a front view of the device with the resistance band attached to a stationary support in broken lines.

The strap 10 further includes an elastic resistance band 70 (see FIG. 5). In application, one end 71 of the resistance band 70 is grounded or secured to a suitable stationary support, and an opposite end 72 of the resistance band 70 is releasably attached to one or both of the hip members' rings 49, 59.

In application, the first belt 15 is securely supported about the user's hips as described. The second belt, and then third belt is then securely fastened in place. The thigh straps 40 are trained about the inside of the thighs to partially surround the thighs. Application of the first, second, and third belts, and the thigh straps prevent rotation of the first belt 15, such as when the elastic resistance band 70 is mounted to apply an exaggerated force to one side or the other of the first belt 15.

The opposite end 72 of the elastic resistance band 70 is secured to one or both of the wings 49 of the hip members 45, 55. The one end 71 of the elastic resistance band 70 is secured to a stationary support such that the resistance band 70 will apply appropriate counter forces, which can occur from multiple directions, and which provide appropriate feedback to the user.

For example, upon performing the motions required to properly pitch a baseball, the elastic resistance band 70 provides a counter acting force or resistance. The amount of dynamic resistance can be varied based upon the distance between the user and the suitable stationary support, the further the distance between the user and the stationary support, the greater the counter acting force or resistance of the resistance band 70.

The resistance necessary to overcome the force of the resistance band 70 provides a positive feedback to the user. Over time, the user is able to distinguish the feedback tension and correct a defective portion of his or her form.

In the preferred embodiment, the first belt 15 is constructed in a first color, which can be any selected color, and the second belt 20 is constructed in a second color, which can be any color except the first color. The third layer is constructed of a third color, which can be any color except the second color. Similarly, in the preferred embodiment, the thigh strap 40 is constructed in a first thigh strap color, which can be any selected color, and thigh strap 50 is constructed in a second thigh strap color, which can be any color except the first thigh strap color.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. An athletic training device comprising:

a strap portion that is secured around a user's waist with a first attachment, a first hip member having a first strap that outwardly extends from a first point on said strap portion, said first point located approximately above the user's hip joint, and a second strap that outwardly extends from a second point on said strap portion, said second point located approximately below the user's hip joint, wherein distal ends of said first and second straps merge and are attached to a ring and a spacing is disposed between the ring and the strap portion, an elastic resistance band having one end grounded and an opposite end configured to attach to said first hip member.

2. The device as recited in claim 1, wherein said device is constructed of a first color.

3. The device as recited in claim 2, further including a second strap portion that is secured around the user's waist with a second attachment, said second strap appropriately attached to said strap portion at a central location of a back portion of said strap portion.

4. The device as recited in claim 3, wherein said second strap is constructed of a second color, said second color is different from said first color.

5. The device as recited in claim 3, wherein said first and second attachments are a Velcro attachment.

6. The device as recited in claim 1, further including a second hip member having a first strap that outwardly extends from said first point and a second strap that outwardly extends from said second point, and wherein distal ends of said first and second straps of said second hip member merge and attach to a second ring, and a spacing is disposed between the second ring and the strap portion.

7. The device as recited in claim 6, wherein said first hip member extends from a first side of the user, and said second hip member extends from a second, opposite side of the user.

8. The device as recited in claim 1, further including first and second thigh straps that depend about the inside of the user's thighs to partially surround the thighs, each of said thigh straps include a third attachment.

9. The device as recited in claim 8, wherein said third attachment is a buckle attachment.

10. An athletic training device comprising:

a first belt, and a second belt, said first belt includes a strap portion that is secured around a user's waist and releasably secured at an approximate central location of a front portion of the strap portion with a first attachment, said second belt is releasably secured around the user's waist with a second attachment, said second belt is appropriately attached to the first belt with stitching at a central location of a back portion of the strap portion, said first belt further includes first and second thigh straps that depend about the inside of the user's thighs to partially surround the thighs, each of said thigh straps include a third attachment, a first hip member disposed on a first side of the first belt and a second hip member disposed on a second side of the first belt, said first side opposite the second side, said first and second hip members each include a first strap and a second strap, a first end of the first strap of the first hip member outwardly extends from a first upper point on the first belt that is approximately above the user's hip joint, and a first end of the first strap of the second hip member outwardly extends from a second upper point on the first belt that is approximately above the user's hip joint, and a first end of the second strap of the first hip member outwardly extends from a first lower point on the first belt that is approximately below the user's hip joint, and a first end of the second strap of the second hip member outwardly extends from a second lower point on the first belt that is positioned approximately below the user's hip joint, wherein an opposite end of the first strap of the first hip member merges with an opposite of the second strap of the first hip member and said opposite ends of said first hip member are attached to a first ring, and wherein an opposite end of the first strap of the second hip member merges with an opposite end of the second strap of the second hip member and said opposite ends of said second hip member are attached to a second ring, and wherein a first spacing is disposed between said first ring and the strap portion, and a second spacing is disposed between said second ring and the strap portion, an elastic resistance band having one end grounded and an opposite end configured to releasably attach to one or both of said first and second rings.

11. The device as recited in claim 10, wherein the first belt is constructed in a first color and the second belt is constructed in a second color, which second color is different from the first color.

12. The device recited in claim 11, further including a third belt appropriately attached to the second belt with stitching located at a central location of a back portion of the second belt.

13. The device as recited in claim 12, wherein said third belt is constructed of a nylon webbing material.

14. The device as recited in claim 13, wherein said first and second attachments are a Velcro attachment.

15. The device as recited in claim 14, wherein said third attachment is a buckle attachment.

16. The device as recited in claim 12, wherein the third belt is constructed of a third color, which third color is different from said second color.

17. The device as recited in claim 16, wherein said first thigh strap is constructed in a first thigh strap color and said second thigh strap is constructed in a second thigh strap color, which second high strap color is different from said first thigh strap color.

18. The device as recited in claim 10, wherein said strap portion has a width that is approximately 9 inches wide.

19. The device as recited in claim 18, wherein a width of said second belt is less than said width of said strap portion.

20. The device as recited in claim 10, wherein said first ends of the first spacing and said second spacing each form a triangle configuration.

* * * * *